US006165036A

United States Patent [19]

Hino et al.

[11] Patent Number: 6,165,036

[45] Date of Patent: Dec. 26, 2000

[54] WATER TANK FOR WIRELESS REMOTE-CONTROLLED UNDERWATER TOYS

[75] Inventors: Shigeru Hino; Yoshinobu Nikaido; Shinji Yamaguchi, all of Kanagawa, Japan

[73] Assignee: Kyosho Corporation, Tokyo, Japan

[21] Appl. No.: 09/131,752

[22] Filed: Aug. 10, 1998

[30] Foreign Application Priority Data

Aug. 27, 1997 [JP] Japan ..... 9-231097

[51] Int. Cl.[7] ..... A63H 23/04; G09F 19/00; A01K 63/00

[52] U.S. Cl. ..... 446/154; 40/406; 119/256

[58] Field of Search ..... 446/175, 219, 446/153, 154, 155, 120, 161, 112, 956; 410/406, 427; 119/253, 256, 257, 269

[56] References Cited

U.S. PATENT DOCUMENTS

| | | | |
|---|---|---|---|
| 1,481,435 | 1/1924 | Rossberger | 119/256 |
| 2,589,268 | 3/1952 | Less . | |
| 3,092,060 | 6/1963 | Reid | 446/154 X |
| 3,324,573 | 6/1967 | Lavallee | 119/256 X |
| 3,557,754 | 1/1971 | Bader | 119/256 |
| 3,579,368 | 5/1971 | Bleiweiss | 119/269 X |
| 3,730,138 | 5/1973 | Schowski | 119/253 |
| 3,763,997 | 10/1973 | Willinger et al. | 119/253 X |
| 4,006,711 | 2/1977 | Frank | 119/256 |
| 4,826,465 | 5/1989 | Fleischmann | 46/155 X |
| 5,026,287 | 6/1991 | Yamada | 446/488 X |
| 5,344,357 | 9/1994 | Lyczek | 446/154 |
| 5,452,901 | 9/1995 | Nakada et al. | 446/175 X |
| 5,749,320 | 5/1998 | Sydenstricker | 119/253 |

FOREIGN PATENT DOCUMENTS

| | | | |
|---|---|---|---|
| 627248 | 12/1994 | European Pat. Off. | 446/153 |
| 37 00 020 A1 | 1/1988 | Germany . | |
| 588 192 | 1/1946 | United Kingdom . | |

*Primary Examiner*—D. Neal Muir
*Attorney, Agent, or Firm*—Nixon & Vanderhye P.C.

[57] ABSTRACT

A water tank provides an activity space for an underwater wireless remote-controlled toy. A wireless transmitter is positioned within the water tank and emits wireless remote-control signals to the toy, whereby underwater movement of the toy is controlled. The wireless transmitter may transmit either electromagnetic or infrared control signals to the toy.

15 Claims, 4 Drawing Sheets

WATER TANK FOR WIRELESS REMOTE-CONTROLLED UNDERWATER TOYS

FIELD OF THE INVENTION

The present invention relates to a water tank which provides an appearance of weightlessness in the outer space, atmospheric conditions or the like. More specifically, movement of an underwater toy may be controlled remotely by a wireless transmitter (e.g., which transmits either electromagnetic or infrared control signals) disposed within the tank. The toy thereby gives an impression that it is slowly cruising in a weightlessness condition or is flying atmospheric conditions.

BACKGROUND AND SUMMARY OF THE INVENTION

Conventional flying toys, such as remote controlled toy airplanes, helicopters or the like are known and are operated in the open air. Therefore, such toy air planes or helicopters are basically similar in structure to real machines which they replicate.

Underwater toys driven by a wireless means, such as toy submarines, are also known and are typically operated in a relatively expansive environment, such as a pond or the like. Such toy submarines are again of a similar structure to real submarines which they replicate in that the volume of the air in the ballast tank is adjusted for the toy submarine to surface or dive.

Since flying toys and toy submarines are of a similar structure to real machines which they replicate, they typically are plagued by relatively high manufacturing costs to an extent that the resulting retail prices are too high that children cannot easily afford to buy them. Furthermore, operating flying toys is an art which is extremely difficult to learn. As a result, such flying toys tend to crash and break during flight involving a substantial amount of expense for repair. On the other hand, toy submarines often face a problem in that they can venture beyond the range of wireless communication while submerged resulting in the toy becoming lost. Since both flying toys and the toy submarines require an extensive space in which to operate, they are clearly not well suited to indoor entertainment.

The present invention was made to solve the above described problems. In this regard, one object of the present invention is to provide a water tank which fulfills the fantasy of an outer space townscape or a view under atmospheric conditions in the sky such that a toy set afloat therein gives an illusory view of an object cruising in the outer space weightlessness or flying in the atmosphere. According to the present invention, therefore, the submersible toys moving around in the water contained in the water tank are free from the risk of crashing or being lost.

A further object of the invention is to provide a water tank which defines a quasi-space which is free from the risk of operational failure because the wireless signal transmitter (e.g., a wireless antenna or an infrared ray emitting diode) is positioned physically in the water tank such that operational failures are avoided due, for example, to electromagnetic wave dead space.

In order to accomplish the above mentioned objects, the water tank which defines a quasi-space according to the present invention has as a background section provided at a back surface thereof and/or a georama section provided on a floor thereof. The background section may thus have a background picture while the georama may have an imitation town whereby a toy is driven relative thereto by means of wireless remote-controlled signals. The background may, for example, be representative of an outer space environment, while the imitation town provided with the georama may be a complementary futuristic space town.

The water tank of the present invention may further include a top section equipped with an ultraviolet rays emitter which responsively causes fluorescent paint on the background picture to glow. The submersible toy vehicles employed in the present invention may have a driver's seat and an imitation light portion in the proximity thereof. The imitation light may include a portion painted with a fluorescent paint so as to provide an image of a light being turned on in the ultraviolet rays emitted by the ultraviolet rays emitter.

The submersible toy vehicle that is employed in the present invention may also be subjected to a buoyancy setting such that said toy normally floats on the water surface and is driven to submerge in the water. Alternatively, the said toy buoyancy setting may be such that the toy normally submerges below the water surface and is driven to surface.

It is further acceptable to further include at least one antenna provided at a desired location within said water tank for wireless remote control. In this regard, at least one antenna is most preferably arranged along an inner wall of the water tank. Furthermore, the georama may be provided with an imitation antenna which functionally serves as the antenna used to transmit the remote-control signals. The antenna may alternatively be buried in a corner portion of the water tank.

In case where an infrared control means are used as the remote-control signal transmitter, the infrared ray emitting diodes are preferably submerged underwater. Furthermore, it is especially preferred that each infrared ray emitting diode be provided at respective opposite corners of the water tank.

BRIEF DESCRIPTION OF THE DRAWINGS

Hereinafter, the present invention, which is directed to a water tank defining a quasi-space, will be explained with reference to the accompanying drawings, wherein.

DETAILED DESCRIPTION OF THE PREFERRED EMBODIMENTS

Figure 1:
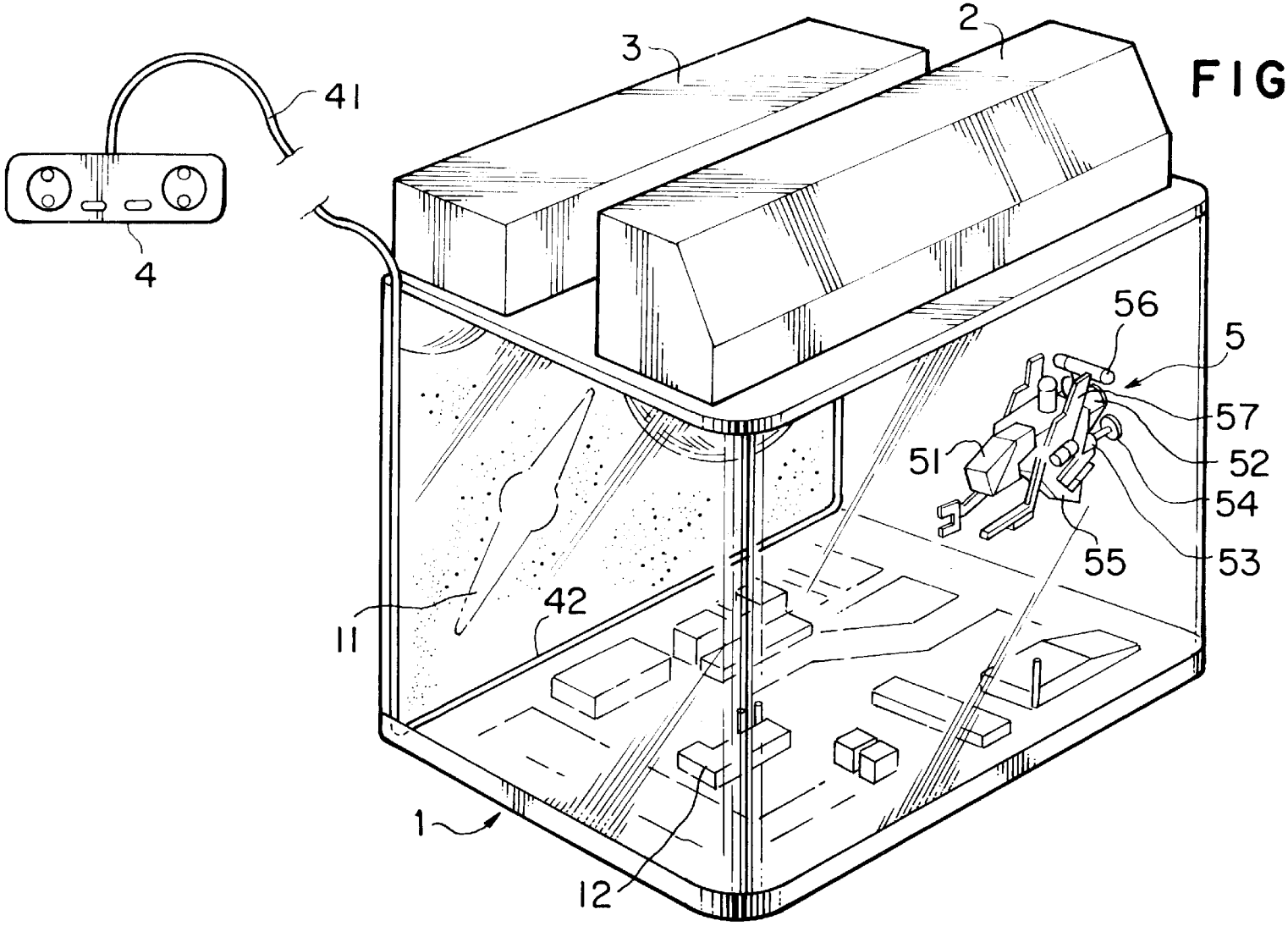
FIG. 1 is a perspective view of the present invention showing a water tank defining a quasi-outer space.

As shown in FIG. 1, a conventional water tank 1 used for raising tropical fishes may be provided in accordance with the present invention. The water tank 1 is comprised of a front and side sections of a transparent material, and a background section provided at a back side thereof. The background section has a picture 11 depicting, for example, an outer space scene, which may be photographed or drawn by computer graphics. The picture 11 may be painted onto the background using a fluorescent paint.

The water tank 1 most preferably has a floor in the form of a georama 12 showing an outer space townscape with a toy spaceship floating thereabove and a planet illustration in the background picture. The interior scene of the water tank 1 thereby defines a quasi-outer space in cooperation with the background section.

An ultraviolet ray emitter 2 may be provided on the top of the water tank 1. The emitter 2 thereby irradiates ultraviolet rays which cause the background picture 11 to glow, thus giving an illusory outer space impression to the players. In addition, by applying fluorescent paint on the background picture 11 or on a lamp portion in the proximity of a driver's seat 51 of a toy 5 which will be explained later, the painted portions are brighter and thereby more easily viewed. Particularly, the light portion glows when exposed to ultraviolet rays and is made more visible thereby giving the illusion that the light is actually turned on. A water purifier 3 equipped on the top of the water tank 1 is provided so as to purify and circulate the water in the water tank 1. However, the water purifier 3 is not essential to the functioning of the present invention.

A radio controller 4 is operatively coupled to an antenna 41 which extends into the case as shown in FIG. 1. The tip of the antenna 41 is bent to extend along the backside of said water tank 1 and is coupled operatively to the antenna section 42 disposed physically within the water tank 1.

A radio controlled toy 5 is controlled by the controller 4. The toy 5 depicted in FIG. 1 is constructed in the form of a spaceship which has a cockpit 51 with a built-in secondary battery and a receiver so as to weigh heavier than its tail portion 52. As a result of this weight differential, the cockpit 51 submerges while the tail 52 floats on the water surface. Propellers 54 attached to the opposite lateral sides of the rear portion of the toy 5 are driven by micro motors 53. The floating toy 5 thus starts to submerge in response to the propellers 54 being turned. The toy 5 is subject to a buoyancy setting by means of a weight balancer 55 and an air tank 56 such that the toy starts to surface when the propellers 54 stop turning. The toy 5 includes an antenna 57 connected to the receiver within the toy 5.

In operation, the toy 5 is initially set afloat on the water surface in the water tank 5. Issuance of a "forward" signal by the controller 4 is received by the antenna 57 of the toy 5 and sent to the toys' internal receiver. The receiver is adapted to drive two micro motors 53 which responsively cause the two propellers 54 to turn, thus submerging the toy 5. If only one of the left or right propellers 53 turns, however, the toy 5 starts to change its direction to the right or to the left, respectively. In this way, the toy 5 submerges in addition to turning right or left within the georama 12. As a result, the toy 5 is viewed as if cruising in an outer space to excite the players' interest.

The electromagnetic waves transmitted to the toy 5 are issued by the antenna 42. The positioning of the antenna 42 within the water tank 1 ensures that the electromagnetic waves reach the toy 5 since the strength of the electromagnetic waves are kept sufficiently high by being directly emitted through the glass case from outside, thus assuring a reliable remote control operation.

The purifier 3 is provided to generate an eddy current in the water tank 1 to cause the toy 5 to encounter operational difficulties as if under the influence of a black hole in outer space.

When the operation of the controller 4 is stopped, the micro motor 53 ceases to operate such that the toy 5 loses its driving force. The toy spaceship 5 thereby surfaces by virtue of its inherent buoyancy.

In the case of the toy 5 specified in the foregoing mode of embodying the invention, the toy is normally adapted to float on the surface of the water and submerges by the driving force of propellers 54. However, it is acceptable that the toy may be normally adapted to submerge to the bottom of the water and is driven to surface. In such a case, however, the buoyancy setting is made such that the toy is caused to generally sink down onto the floor while the buoyancy at the cockpit 51 is maintained.

Figure 2:
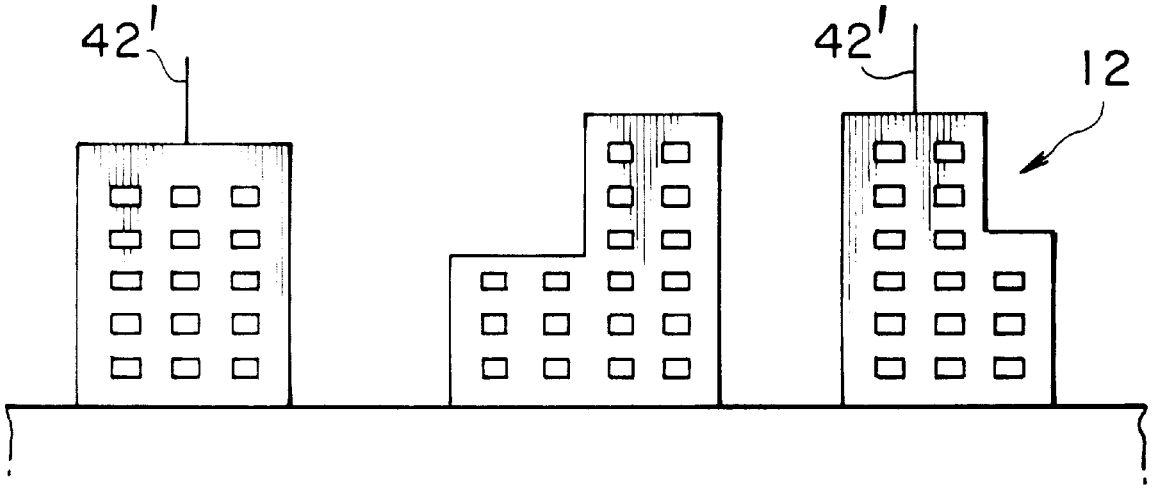
FIG. 2 is a front view of part of the georama in FIG. 1.

In the foregoing embodiment of the present invention, the antenna 42 is manufactured in the form of the letter U and is attached to the wall of the water tank 1. However, a plurality of imitation antennas 42' provided in the georama 12 as shown in FIG. 2 may be connected to the controller 4 to eliminate a dead angle that may otherwise be present within the water tank 1.

Figure 3:
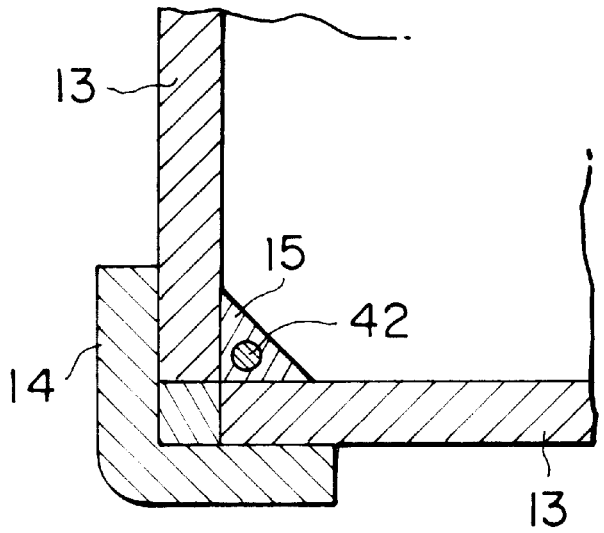
FIG. 3 is a cross section showing an antenna buried at the corner of the water tank.

As shown in FIG. 3, the antenna 42 may also be buried in the water proofing agent 15 used to connect adjoining corner portions of glass plates 13 forming the water tank 1 adjacent to the external support frame 14 thereof.

Figure 4:
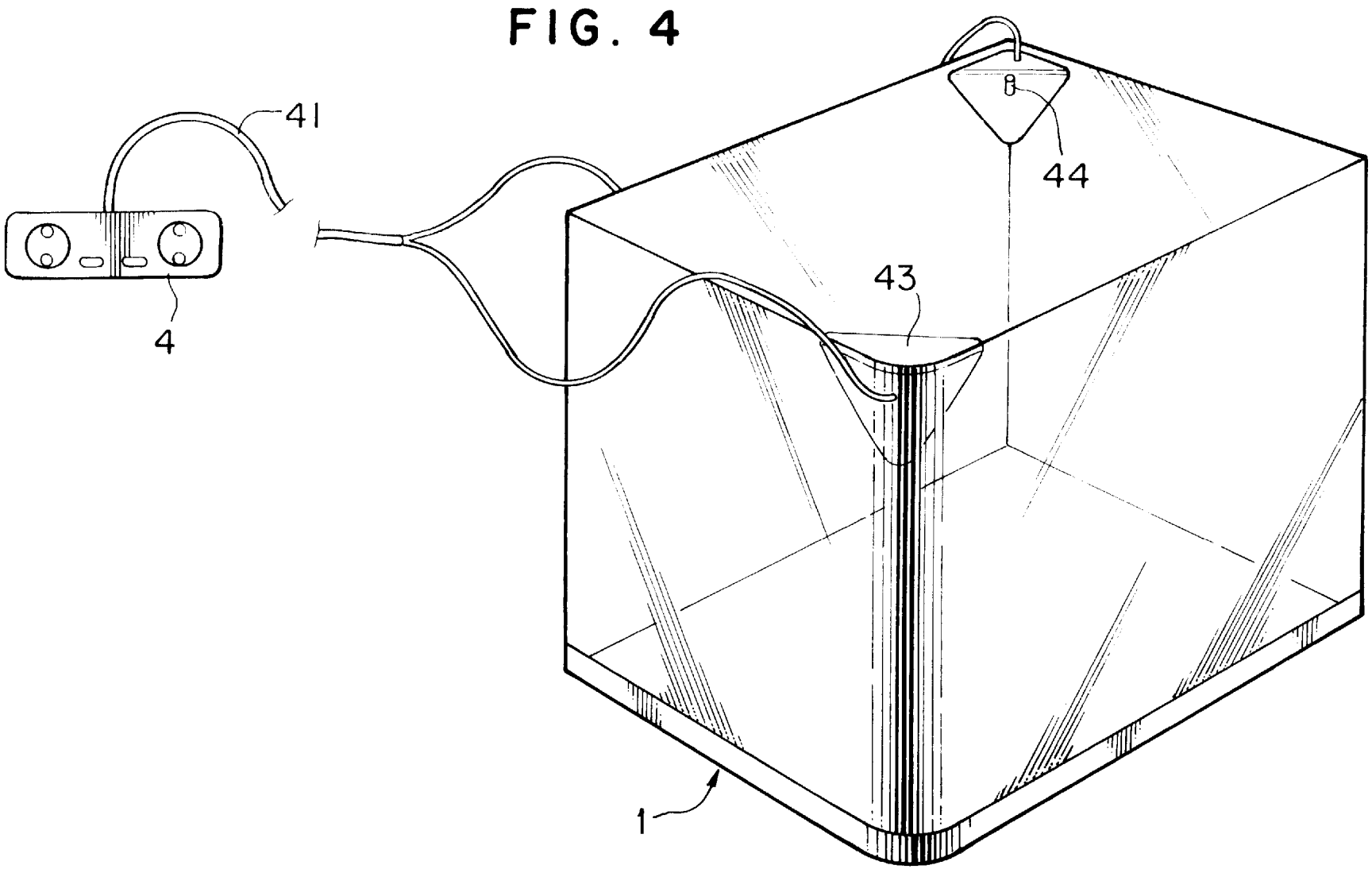
FIG. 4 is a perspective view of an infrared ray emitting diode being arranged at a corner of the water tank.
Figure 5:
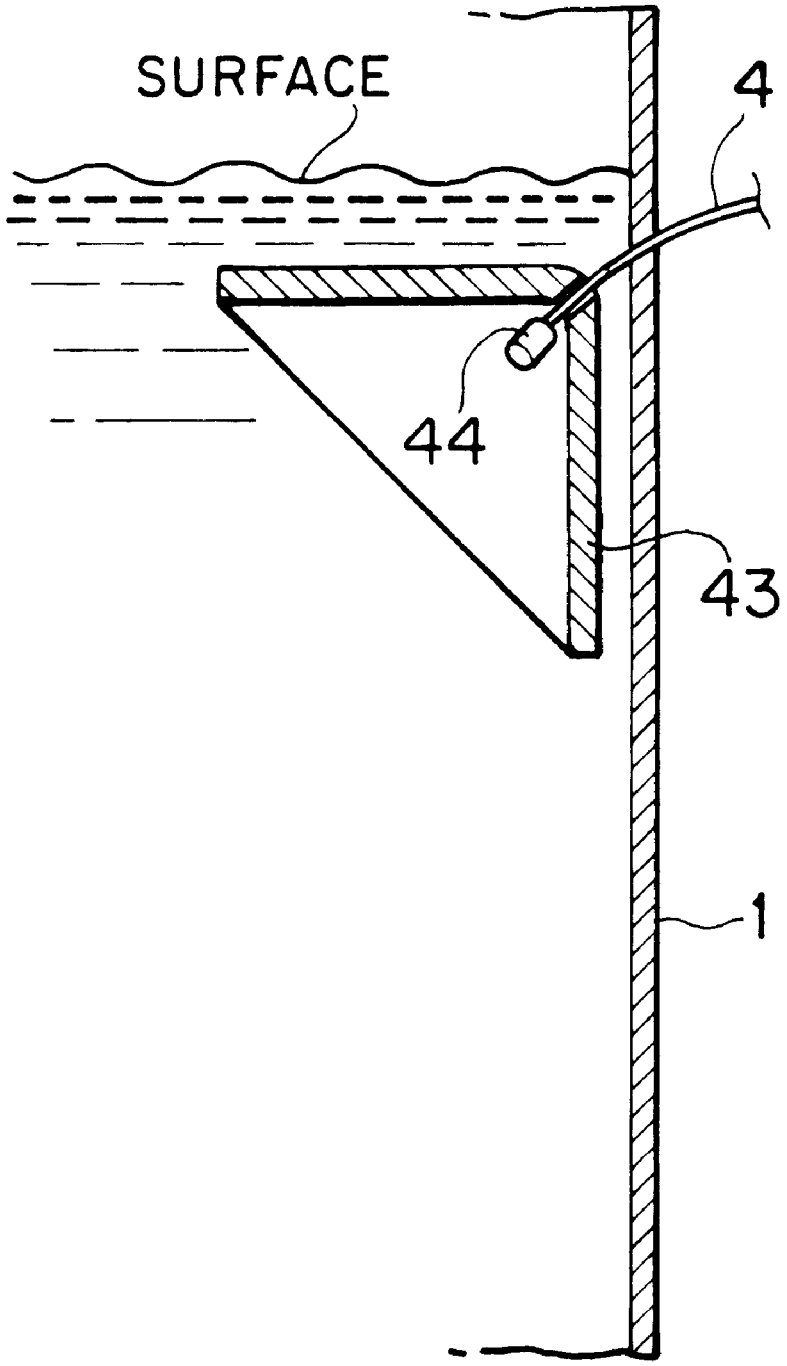
FIG. 5 is a sectional view of locations where an infrared ray emitting diode case may be positioned within the water tank.

When infrared means are used instead of radio means, it is preferable that infrared ray emitting diodes contained in water tight cases 43 are provided at the opposite corners of the water tank below the water surface such that infrared rays are irradiated onto the light receiver provided in the toy 5. In this connection, the infrared ray emitting diodes 44 are mounted so as to direct the infrared rays downwardly within the water tank 1 as shown in FIG. 4. As a result, the infrared rays will reach all areas within the water tank 1. Although not shown, the light receiver provided in the toy 5 is positioned in the cockpit 51.

While the water tank 1 most preferably is configured to simulate a town in outer space, it is also possible that the background picture 11 and the georama 12 are such that they imitate an atmospheric landscape above which a plane or helicopter is flying. Thus, although underwater, the toy plane or helicopter may be manipulated to slowly cruise in the imitation sky in which it moves due to the resistance of the water in the tank 1.

Alternatively, the background picture 11 and the georama 12 may imitate an earthly landscape. In such a situation, the toy 5 may be in the form of an imitation motorbike or the like which is deposited upright on the floor of the water tank. The toy motorbike may thus be moved on the georama without falling down. Particularly, by giving sufficient buoyancy to the head portion of a dummy motorcyclist on the motorbike, it is possible to maintain such an imitation motorbike in an upright condition.

A relatively large sized water tank may used such that multiple toys are capable of being simultaneously radio-controlled by a plurality of players. In such a situation, a number of antennae corresponding in number to that of the players are needed and arranged similar to the antenna 42.

As explained above, the present invention is composed of a water-filled tank which defines a quasi-outer space comprising a background section provided at a back side thereof and having a background picture and/or a georama section formed on the floor thereof provided with an imitation outer space town. A toy is thus driven by wireless remote control to move around the tank thereby giving an illusory impression of a spaceship cruising in the weightless condition of outer space. It is possible to improve the realism of the effects by applying fluorescent paint onto the background picture and providing an ultraviolet ray emitter on the top of the water tank to cause the background picture to visibly glow when illuminated. Alternatively or additionally, it is possible to cause the light portion in the toy to appear as if a light is turned on by applying ultraviolet paint thereon.

Since the toy spaceship operated by wireless means or infrared rays is adapted to normally float on the water surface or sink underwater through appropriate buoyancy settings, the surfacing and submerging operations are performed only through driving the toy. It is thus possible to reduce the manufacturing cost thereof without the need for a number of channels to be designed for such surfacing and submerging operations.

The present invention also avoids those instances where interference causes operational failures with conventional external control operations by virtue of the radio controller antennae or the infrared ray emitting diodes being arranged underwater within the water tank. In this regard, imitation antennae may also be put to actual use or they may be buried in the water proofing agent used at the joint of the glass plates to avoid unnatural appearance thereof.

Further, a plurality of toys can be operated by a plurality of players if plural antennae are provided within the water tank. As a result, multi-player entertainment may be had by use of toys of the present invention. In the case where the toy is operated by infrared rays, stable toy operation can be achieved by irradiating infrared rays downwardly thereon from the top comers of the water tank. Moreover, dead angles may be eliminated within the tank by arranging two infrared ray emitting diodes at the respective top corners of the water tank.

What is claimed is:

1. The combination comprising:

a water tank which defines an underwater activity space, said water tank including a radio or infrared wireless transmitter positioned therewithin for emitting wireless radio or infrared remote-control signals, respectively;

a remote-controlled underwater toy operable within the defined underwater activity space of the water tank, said toy including a radio or infrared receiver for receiving said wireless radio or infrared remote-control signals, respectively, from said transmitter within said water tank; and a hand-held controller positioned externally of the water tank and operatively connected to said transmitter therewithin, whereby underwater movement of the toy is controlled.

2. The combination as in claim 1, wherein the wireless transmitter includes at least one radio antenna positioned at a desired location within the water tank.

3. The combination as in claim 2, where said at least one radio antenna is arranged along an inner wall of said water tank.

4. The combination as in claim 2, further comprising a georama, and wherein said at least one radio antenna is visible in said georama as an apparent imitation antenna.

5. The combination as in claim 1, wherein the wireless transmitter includes a radio antenna buried in a corner portion of the water tank.

6. The combination as in claim 1, wherein the wireless transmitter includes an infrared emitter.

7. The combination as in claim 6, wherein the infrared emitter includes an infrared emitting diode positioned underwater within the water tank.

8. The combination as in claim 6, wherein said infrared emitter includes a plurality of infrared emitting diodes positioned underwater within the water tank.

9. The combination as in claim 8, wherein said infrared emitting diodes are positioned at respective opposite corners of the water tank.

10. The combination as in claim 1, which further comprises a scenic display.

11. The combination as in claim 10, wherein the scenic display resembles outer space.

12. The combination as in claim 11, wherein said scenic display is painted at least in part with fluorescent paint, and wherein said water tank includes a top section equipped with an ultraviolet ray emitter for illuminating said fluorescent paint.

13. The combination of claim 1, wherein the toy includes at least a portion thereof which is painted in a fluorescent paint, and wherein said water tank includes a top section equipped with an ultraviolet ray emitter for illuminating said fluorescent paint on said toy.

14. The combination of claim 1, wherein the toy includes buoyancy control such that the toy may be commanded to submerge underwater within the tank by transmission of a remote-control submerge-command signal from the transmitter.

15. The combination of claim 1, wherein the toy includes buoyancy control such that the toy may be commanded to surface on the water within the tank by transmission of a remote-control surface-command signal from the transmitter.

* * * * *